United States Patent [19]

Saito

[11] 4,218,601

[45] Aug. 19, 1980

[54] PUSHBUTTON

[75] Inventor: Motoyuki Saito, Higashiyamato, Japan

[73] Assignee: Citizen Watch Co., Ltd., Tokyo, Japan

[21] Appl. No.: 958,661

[22] Filed: Nov. 8, 1978

[30] Foreign Application Priority Data

Nov. 16, 1977 [JP] Japan ..... 52-136735

[51] Int. Cl.[2] ..... H01H 3/12; G04B 19/30

[52] U.S. Cl. ..... 200/159 R; 200/340; 368/290

[58] Field of Search ..... 200/159 R, 340, 159 A, 200/302, 245, 52 R; 58/23 R, 50 R, 85.5, 90 R, 90 B

[56] References Cited

U.S. PATENT DOCUMENTS

| | | | |
|---|---|---|---|
| 3,509,296 | 4/1970 | Harshman et al. | 200/159 R |
| 3,973,099 | 8/1976 | Morris, Sr. | 200/159 R |
| 4,006,335 | 2/1977 | Sanford | 58/50 R X |
| 4,043,115 | 8/1977 | Bryceland | 200/340 X |
| 4,124,791 | 11/1978 | Lewis | 200/159 R |

*Primary Examiner*—Steven M. Pollard

*Attorney, Agent, or Firm*—Birch, Stewart, Kolasch & Birch

[57] ABSTRACT

A pushbutton for actuating a switch of an electronic timepiece wherein the pushbutton may be reduced in diameter. According to the present invention, in order to reduce the diameter of the pushbutton, a packing of resilient material for providing a watertight seal is pressed into a pipe secured to a hole in watch case, the packing is so arranged that it may be axially moved in the pipe by the pushbutton body for actuating a switch provided in the watch case.

6 Claims, 4 Drawing Figures

PUSHBUTTON

BACKGROUND OF THE INVENTION

The present invention relates to a pushbutton for electronic timepieces and more particularly for electronic wristwatches.

The conventional pushbutton for operating a switch provided in a electronic wristwatch comprises a guide pipe secured to the watch case and a button body slidably provided in the pipe. The button body has a circumferential annular groove with which an O-ring is engaged to provide a watertight seal between the pipe and the button body. In such a structure, the button body must have a diameter sufficient to provide the annular groove and also to have necessary strength in the remaining reduced diameter portion. To meet such a requirement, the button body cannot be constructed to be of a small diameter.

On the other hand, the electronic wristwatch has been improved to decrease its thickness and size. Under such circumstances, problems have arisen in that such a large conventional pushbutton is not suited for a wristwatch of reduced size. In addition, the design for the case of a wristwatch is restricted by the pushbutton when attempting to make a wristwatch of reduced size.

SUMMARY OF THE INVENTION

It is an object of the present invention to provide a pushbutton of which the size may be reduced in diameter and which is extremely watertight.

In accordance with the present invention there is provided a pushbutton comprising a pipe secured in a hole in the watch case, a packing of resilient material is pressed into said pipe, and a pushbutton body is slidably engaged with said pipe and positioned adjacent said packing, said packing being adapted to be moved by said pushbutton body to actuate a switch provided in the watch case.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
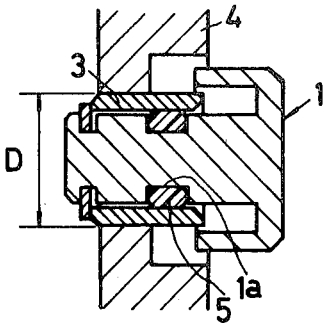
FIG. 1 PRIOR ART
FIG. 1 is a sectional view showing a conventional pushbutton of a wristwatch.

Referring to FIG. 1, there is illustrated a conventional pushbutton, a pushbutton body 1 having a circular cross section has an annular groove 1*a* within which an O-ring 5 is engaged. The pushbutton body 1 is slidably inserted into a pipe 3 secured within a hole provided in a case 4 of a wristwatch, whereby the O-ring is pressed against the pipe 3 to provide a watertight seal between the pushbutton body 1 and the pipe 3.

In such a conventional push-button, the outer diameter D of the pipe 3 may not be reduced less than 2.2 mm in order to ensure that the body 1 will be constructed having the necessary strength. The present invention is to provide a pushbutton which may be reduced in diameter smaller than the limitations of the conventional pushbutton.

Figure 2:
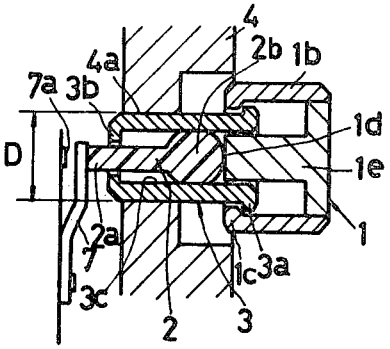
FIG. 2 is a sectional view showing an embodiment of the present invention.

Referring to FIG. 2, the pushbutton body 1 is slidably engaged with the pipe 3 and comprises a central body 1*e* and a pipe 1*b* secured to the central body 1*e*. The pipe 1*b* has an inside flange 1*c* which is adapted to be engaged with a flange 3*a* provided on the outer end of the pipe 3, whereby the pushbutton body 1 is prevented from being removed from the pipe. A packing 2 of synthetic rubber or synthetic resin is pressed into the pipe 3. The packing 2 comprises a spherical body 2*b* and a projection 2*a* inwardly extending from the spherical body which is adapted to engage with a switch plate 7. The pipe 3 has an inside flange 3*b* at the inner end thereof to prevent the removal of the packing 2.

In assembling the pushbutton, the pipe 3 is secured in the hole 4*a* of the case 4 by press fitting. The packing 2 is pressed into the pipe 3 so that the projection 2*a* may be positioned adjacent the switch plate 7. The pushbutton body 1 may be engaged with the pipe 3 by a force axially applied thereto from the outside.

In operation, by pushing the pushbutton body 1, the packing 2 is displaced inside of the case 4 so that the projection 2*a* biases the resilient switch plate 7 to engage an electrode 7*a* to close the contact. During the operation, the packing 2 is radially expanded by the axial compression thereby ensuring a watertight seal between the packing and the inner wall 3*c* of the pipe 3. The pushbutton body is returned to the initial position by the resilient switch plate 7. In accordance with this embodiment, diameter D of the pipe 3 may be decreased to 1.0 mm to 1.4 mm.

Figure 3:
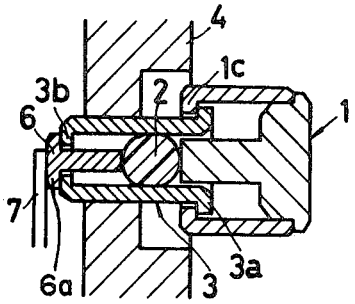
FIG. 3 is a sectional view of another embodiment of the present invention.

Referring to FIG. 3 another embodiment of the present invention is illustrated, the packing 2 in this embodiment is spherical and hence not provided with a projection. Instead of a projection, an intermediate member 6 is provided in the pipe 3 adjacent the packing 2. The intermediate member has a flange 6*a* inwardly projected from the pipe 3 to actuate the switch plate 7. In this pushbutton the switch plate 7 may be more positively actuated by the intermediate member 6 compared with the previous embodiment.

Figure 4:
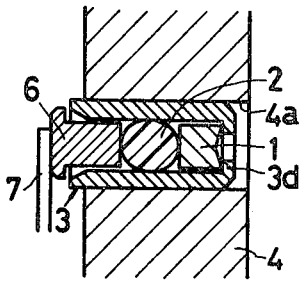
FIG. 4 is a sectional view showing a further embodiment of the present invention.

With reference to FIG. 4 a further embodiment of the the present invention is illustrated, the pipe 3 is not provided with a flange. However, the pipe 3 is fully embeded in the hole 4*a* of the case 4. The pipe 3 has an inside flange 3*d* at the outer end. Positioned within the pipe, a cylindrical pushbutton body 1 is provided between the flange 3*d* and the spherical packing 2 and an intermediate member 6 is also provided adjacent the switch plate 7. The pushbutton body 1 may be pushed by a suitable tool such as tweezers to actuate the switch.

From the foregoing it will be understood that the present invention may provide a pushbutton which may be decreased in diameter compared with a conventional pushbutton. Therefore, the design of a watch case is not restricted by the size of the pushbutton. In addition, since the packing is radially expanded by the pushbutton body, a watertight seal may be ensured during the operation. Further, the switch may be positively actuated by an intermediate member.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A pushbutton for actuating a switch of an electronic timepiece comprising:

a pipe secured in a hole of a watch case;

a spherical packing of resilient material pressed into said pipe; and a pushbutton body slidably engaged with said pipe and positioned adjacent said spherical packing, said spherical packing being adapted to be moved by said pushbutton body to actuate a switch provided in the watch case.

2. A pushbutton according to claim 1, wherein said spherical packing includes a projection inwardly projected from said pipe for actuating the switch.

3. A pushbutton according to claim 1, wherein said pushbutton body comprises a central body inserted into the pipe and a cylinderical portion around the pipe, said cylinderical portion including an inside flange at an inner end adapted to be engaged with a flange provided on an outer end of said pipe.

4. A pushbutton according to claim 1, wherein said pipe is fully embedded in the hole of the watch case and includes an inside flange at an outer end, said pushbutton body being provided in the pipe adjacent the inside flange.

5. A pushbutton for actuating a switch of an electronic timepiece comprising:

a pipe secured in a hole of a watch case;

a spherical packing of resilient material pressed into said pipe;

a pushbutton body slidably engaged with said pipe and positioned adjacent said spherical packing; and an intermediate member provided in said pipe adjacent an inner end of said spherical packing, said spherical packing being adapted to be moved by said pushbutton body to bias said intermediate member to actuate a switch provided in the watch case.

6. A pushbutton according to either claim 1 or 5, wherein said spherical packing of resilient material forms a watertight seal against the interior surface of said pipe.

* * * * *